US008708099B2

(12) United States Patent
Fortin

(10) Patent No.: US 8,708,099 B2
(45) Date of Patent: Apr. 29, 2014

(54) SAFETY ANCHORING DEVICE

(75) Inventor: Dominique Fortin, Fournier (CA)

(73) Assignee: EZ Roof Anchors, 7875819 Canada Inc., Fournier, Ontario (CA)

( * ) Notice: Subject to any disclaimer, the term of this patent is extended or adjusted under 35 U.S.C. 154(b) by 60 days.

(21) Appl. No.: 13/294,556

(22) Filed: Nov. 11, 2011

(65) Prior Publication Data

US 2013/0118093 A1 May 16, 2013

(51) Int. Cl.

| | |
|---|---|
| ***A47L 3/04*** | (2006.01) |
| ***A62B 1/16*** | (2006.01) |
| ***A62B 35/00*** | (2006.01) |
| ***A63B 29/02*** | (2006.01) |
| ***E06C 7/18*** | (2006.01) |

(52) U.S. Cl.
USPC ..... 182/3; 52/698; 52/699; 52/27; 182/45; 182/9; 248/500; 248/925; 482/43

(58) Field of Classification Search
USPC ..... 52/698, 699, 127.5, 164, 160, 159, 27; 182/3, 4, 36, 45, 9, 63.1; 482/43; 248/500, 925, 231.91, 231.9; 411/435, 411/433, 429
See application file for complete search history.

(56) References Cited

U.S. PATENT DOCUMENTS

| | | | | |
|---|---|---|---|---|
| 4,412,407 | A * | 11/1983 | Melfi et al. | 52/699 |
| 5,156,233 | A | 10/1992 | Olsen et al. | |
| 5,529,144 | A | 6/1996 | Henderson | |
| 5,699,875 | A | 12/1997 | Dugan | |
| 5,718,305 | A * | 2/1998 | Palmer | 182/45 |
| 6,016,889 | A * | 1/2000 | Pearcy et al. | 182/3 |
| 6,092,623 | A | 7/2000 | Collavino | |
| 6,173,809 | B1 * | 1/2001 | Cole et al. | 182/3 |
| 6,412,589 | B1 * | 7/2002 | Barlage et al. | 180/377 |
| 6,412,598 | B1 * | 7/2002 | Mackinnon | 182/3 |
| 6,520,290 | B1 | 2/2003 | Carter | |
| 6,688,427 | B2 * | 2/2004 | Cole | 182/113 |
| 6,779,316 | B2 * | 8/2004 | Carroll | 52/698 |
| 7,048,090 | B2 * | 5/2006 | Dean et al. | 182/3 |
| 7,621,098 | B2 * | 11/2009 | Reinert, Sr. | 52/742.1 |
| 2011/0048851 | A1 | 3/2011 | Koneval | |

* cited by examiner

*Primary Examiner* — Chi Q Nguyen
(74) *Attorney, Agent, or Firm* — Haynes and Boone, LLP

(57) ABSTRACT

A portable anchor for use in a fall arrest protection system. The anchor comprises a base for abutment to a solid support structure, a post extending perpendicular from the base, at least one attachment point connected to the post for receiving a connector, and a rod adapted to be inserted through a central bore through the base and post. The rod has an anchoring section at a first end of the rod for frictionally engaging a portion of the solid support structure and a locking section in the vicinity of a second end of the rod for reversibly securing the rod to the post. Also disclosed is a fall arrest protection system that includes the portable anchor described above. Furthermore, a method of attaching the portable anchor to a solid support structure is also disclosed.

18 Claims, 7 Drawing Sheets

SAFETY ANCHORING DEVICE

FIELD OF INVENTION

The present invention relates broadly to safety arrangements and devices for ensuring the safety of workers while stationed on a roof or an elevated structure. More particularly, the present invention is directed towards an apparatus and method whereby a secure lifeline attachment point can be provided for use in industrial applications, for instance by connecting to beams, joists and the like.

BACKGROUND OF THE INVENTION

In conventional fall arrest protection systems, lifelines are directly or indirectly secured to a fixed structure and connected to the worker via a harness, safety belt or other similar device. However, it is a common challenge to ensure that lifelines are secured to appropriate attachment points, so that workers remain safely secured via the lifeline should an accidental fall or emergency situation arise. Providing a suitable anchoring structure is especially difficult at construction sites, where permanent attachment fixtures or devices are not available or have not yet been installed.

U.S. Pat. No. 5,699,875 describes a safety anchor comprising a rod with an anchoring member located at its lower end that mates with and is received into a concavity formed in a pre-cast concrete deck panel. The rod is rotated to cause the anchoring member to grasp the inner surface of the concavity and secure the device to the deck panel. The safety anchor also includes a loop to which a line may be secured. However, this device is limited by the need for concrete panels with pre-cast concavities that are shaped to mate with the described anchoring member. If such panels are not part of the construction project or design, the safety anchor will be of limited use.

Other prior art devices that involve drilling into or embedding elements into concrete, or employing spring loaded members, are often less desirable because of their complicated structures or installation procedures. In addition, some safety devices limit the worker's range of mobility.

SUMMARY OF THE INVENTION

The present invention provides a safety device which addresses at least some of the problems encountered with conventional devices, and which can be used by workers in a variety of construction environments.

According to an aspect of the present invention, there is provided a portable anchor for use in a fall arrest protection system. The anchor is made up of a base for abutment to a solid support structure, a post extending perpendicular from the base, at least one attachment point connected to the post for receiving a connector, and a rod adapted to be inserted through a central bore through the base and post. The rod has an anchoring section at one end of the rod for frictionally engaging a portion of the solid support structure and a locking section in the vicinity of the other end of the rod for reversibly securing the rod to the post.

In one embodiment, the base comprises a bracket that abuts the solid support structure.

In another embodiment, the bracket is dimensioned to accommodate a portion of the solid support structure to minimize lateral movement of the base in relation to the solid support structure.

In a further embodiment, the portable anchor described above has a sleeve that at least partially encircles the post and is adapted for rotation about the longitudinal axis of the post. The at least one attachment point is indirectly connected to the post through the sleeve in this embodiment.

In a yet further embodiment, the portable anchor described above has a first annular flange positioned on the post to vertically support the sleeve.

In a still further embodiment, the portable anchor described above has a second annular flange positioned on the post vertically above the sleeve to minimize vertical movement of the sleeve in relation to the post. A central bore is provided in the second annular flange to accommodate passage of the rod.

In another embodiment, the portable anchor described above has one or more trusses bridging the base and the post.

In a further embodiment, the locking section of the rod comprises threads circumnavigating the rod which can be operably engaged by a corresponding internally threaded female substrate to draw the rod toward the base.

In yet a further embodiment, the internally threaded female substrate is selected from a hexagon nut, wing nut and handle.

In a still further embodiment, the locking section of the rod comprises one or more holes adapted to receive a cotter pin, which in operation, maintains the rod at a set position in relation to the base.

In another embodiment, the at least one attachment point pivots with respect to the post.

In a still further embodiment, the at least one attachment point comprises two attachment points.

According to another aspect of the present invention, there is provided a fall arrest protection system comprising an anchor as described above.

According to another aspect of the present invention, there is provided a method of attaching the portable anchor to a solid support structure. The method comprising the steps of: inserting the anchoring section of the rod between a portion of two adjacent solid support structures; positioning the portable anchor over the rod so that the rod passes through the central bore; and engaging the locking section of the rod to draw the anchoring section of the rod towards the base until the anchoring section frictionally engages a portion of the solid support structure.

BRIEF DESCRIPTION OF THE DRAWINGS

These and other features of the invention will become more apparent from the following description in which reference is made to the following drawings.

DETAILED DESCRIPTION

The following description is of a preferred embodiment by way of example only and without limitation to the combination of features necessary for carrying the invention into effect.

The portable anchor described herein can be used in a fall arrest protection system. The typical components of a fall arrest protection system include: anchorage, body wear, a connector and deceleration device. The anchorage device, such as the one described herein, connects to a solid support structure, such as the framing of the building. Body wear is worn by the user and typically consists of some form of harness. The connector, such as a lanyard, connects the body wear to the anchorage. The deceleration device is a component designed to dissipate energy associated with a fall arrest event.

Figure 1:
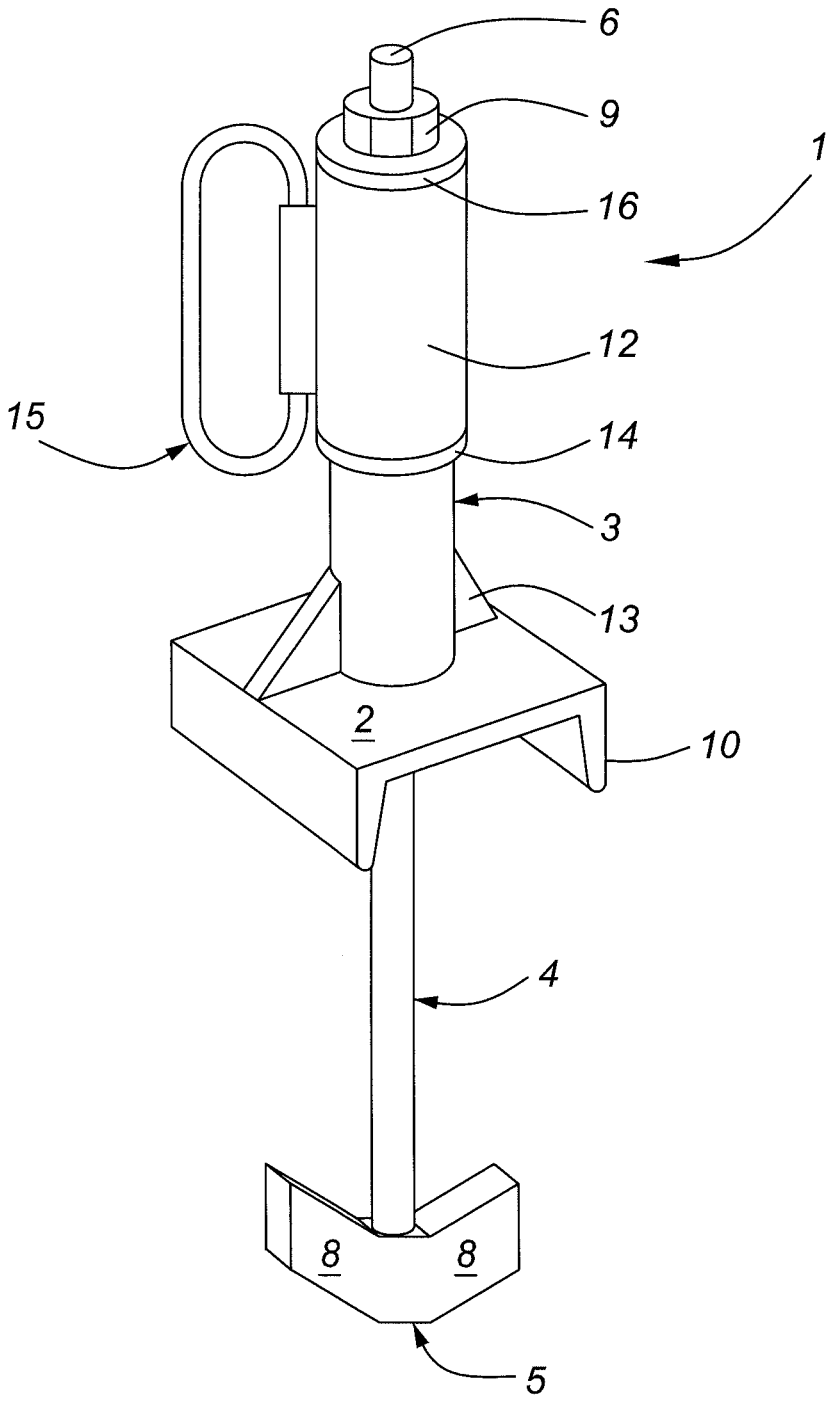
FIG. 1 shows a perspective view of an example of a portable anchor in accordance with one embodiment of the present invention.
Figure 2:
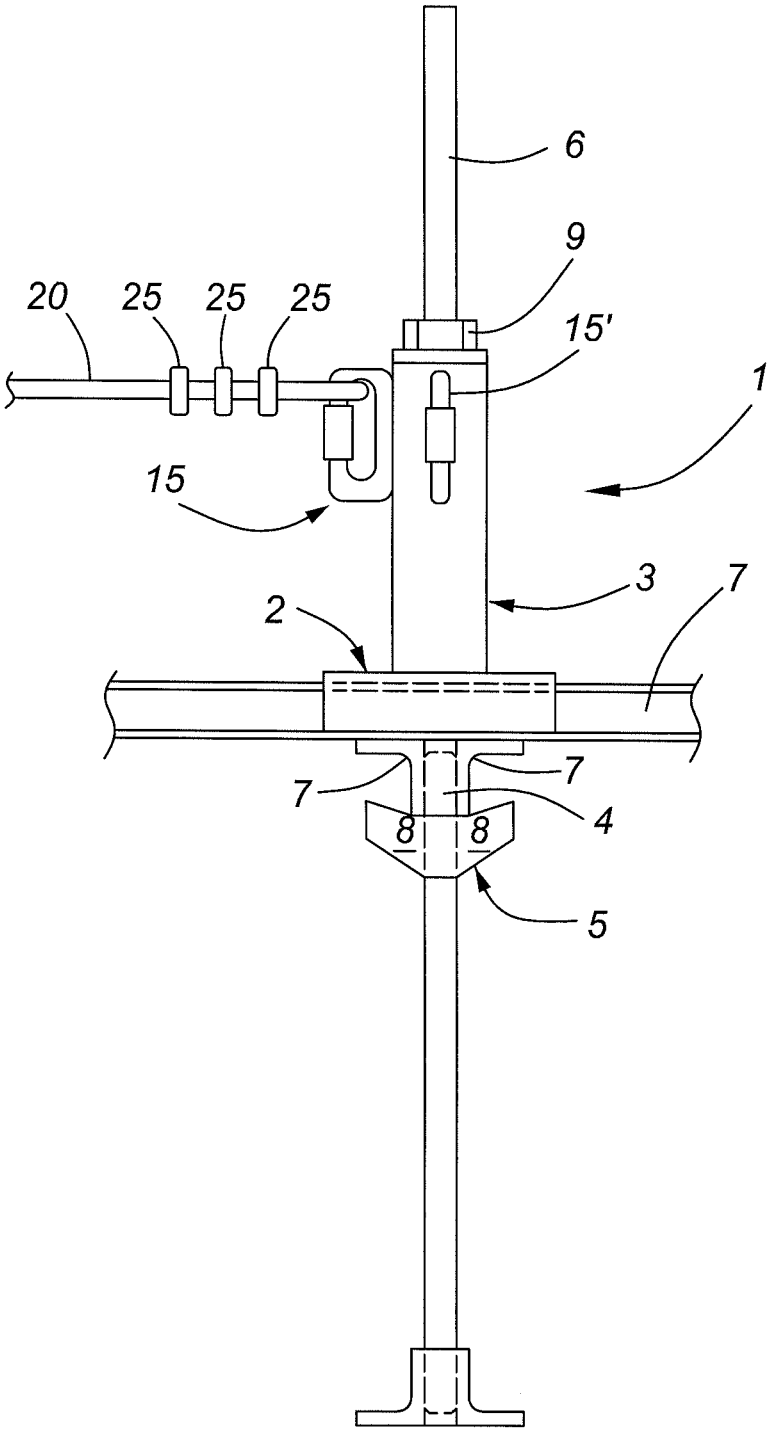
FIG. 2 shows a side view of a portable anchor in accordance with one embodiment of the present invention.

As shown in FIGS. 1 and 2, the anchor (1) includes a base (2) for abutment to a solid support structure, a post (3), which extends perpendicular to the base (2), an attachment point (15) connected to the post (3) and a rod (4) that is inserted in a central bore that extends through the base (2) and post (3) to secure the anchor (1) to the solid support structure.

Figure 4:
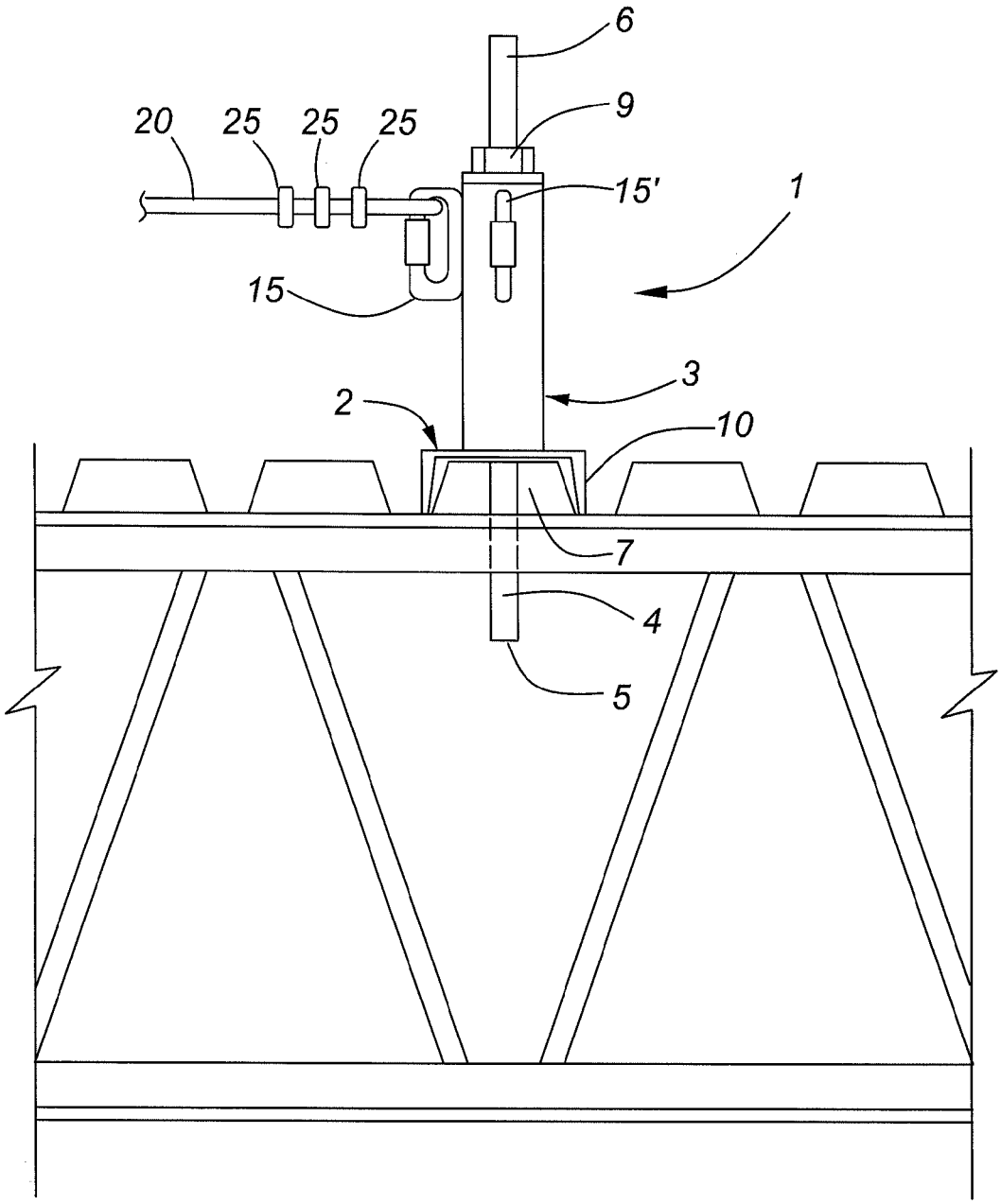
FIG. 4 shows a side view of an example of a portable anchor in accordance with an additional embodiment of the present invention in operation, secured directly to a beam with decking.

The base (2) is of suitable dimension to support the post (3) and to prevent tipping of the anchor (1) in the case of a fall arrest event. In one embodiment, as shown in FIG. 4, the base (2) includes a bracket (10) that can be dimensioned to accommodate a portion of the solid support structure (7), such as, but not limited to, a decking element, to minimize lateral movement of the base (2) in relation to the solid support structure (7).

Figure 5:
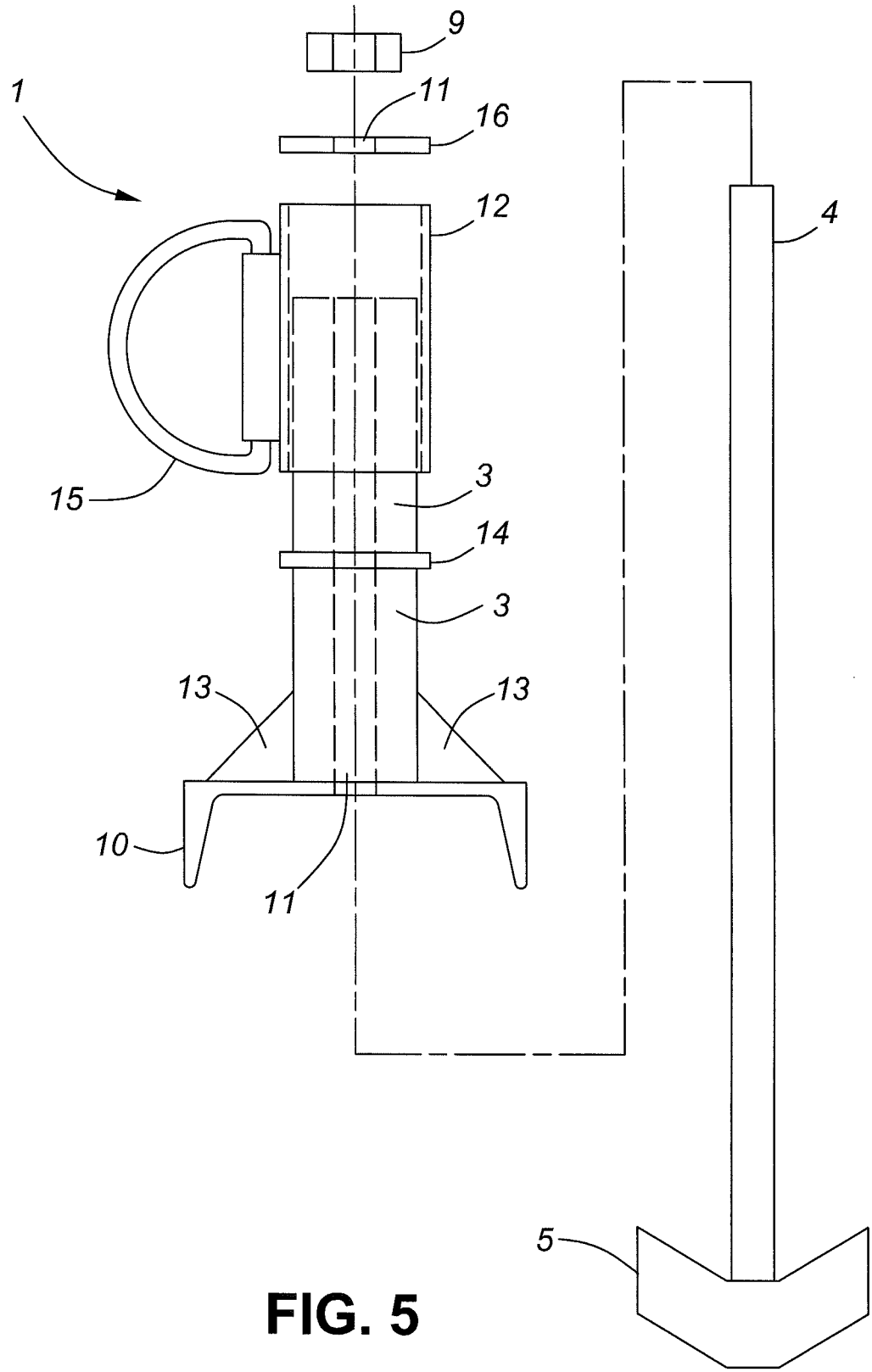
FIG. 5 shows an exploded view of an example of a portable anchor in accordance with an additional embodiment of the present invention.

The post (3) is attached to the base (2) and extends perpendicularly from the base (2). Preferably, the post (3) is cylindrical in shape, however, other shapes, such as rectangular, can also be used. As shown in FIG. 5, a central bore (11) is provided through the base (2) and post (3) to accommodate the rod (4).

To further support the post (3), one or more trusses (13) can be provided bridging the base (2) and post (3) (see FIG. 1). In most cases, the trusses (13) will be triangular is shape (as shown in FIG. 1), which minimizes contact by the connector with truss edges.

In one embodiment, a sleeve (12) is provided that at least partially encircles the post (3) (see FIG. 1). The sleeve (12) is adapted for rotation about the longitudinal axis of the post (3). In most cases, rotation can be achieved by making the internal diameter of the sleeve (12) slightly larger than the exterior diameter of the post (3), and packing the interstitial space between the two components with grease or other lubricants. However, other methods can be applied to achieve rotation of the sleeve (12) with respect to the post (3), such as providing a ball bearing interface between the sleeve (12) and the post (3). Providing a rotatable sleeve (12) allows the user tethered to the anchor (1) 360° movement about the anchor (1).

In order to accommodate both a rotatable sleeve (12) and the trusses (13), it may be necessary to make the sleeve (12) encircle only a portion of the overall length of the post (3). In this embodiment, an annular flange (14) may be provided around the post (3), or integrated therein, to support the sleeve (12). A second annular flange (16) may be also be provided to minimize the vertical movement of the sleeve along the longitudinal axis of the post (3). The second annular flange (16) may be provided along the longitudinal axis of the post (3) or may cap the post (3). If the second annular flange (16) is provided as a cap for the post (3) then the central bore (13) should be extended through the flange (16).

The attachment point (15) is either directly connected to the post (3), or in the case when a sleeve (12) is provided, the attachment point (15) attaches indirectly to the post (3) through the sleeve (12). The attachment point (15) can be any one of a number of different tether anchors, such as steel quick links, D-rings or other loop fasteners that allow for a connector, such as a wire rope (20), to be passed through. Although it is preferable that the user directly connect to the attachment point (15) it is also possible for a wire rope (20) to be passed through the attachment point (15) and one or more clips (25) to be installed on the wire rope (20). The user(s) can then connect their safety lines directly to these clips (25).

Figure 6:
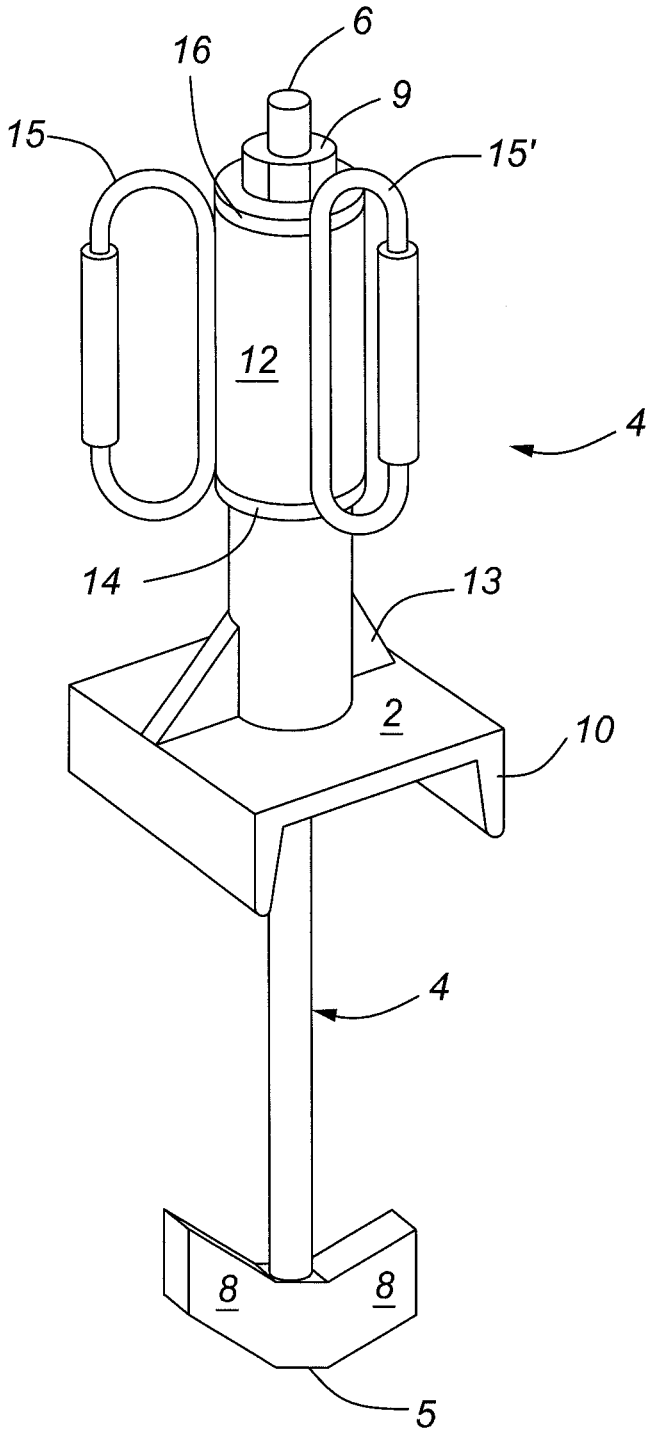
FIG. 6 shows a perspective view of an example of a portable anchor in accordance with an additional embodiment of the present invention.

As shown in FIGS. 2 and 6, depending on the application, two or more attachment points (15, 15') may be provided on the post (3) or sleeve (12). This arrangement allows two or more users to be connected to the same anchor, or allows two or more connectors from the same user to be attached to a single anchor.

In another embodiment, the attachment point (15) is provided so that it is able to pivot with respect to the post (3). Providing a pivotable attachment point (15) allows for greater flexibility in the movement of the user tethered to the anchor.

The anchor (1) described herein can be used in a variety of construction projects and can be moved from construction site to construction site, or within the same construction site. For some construction projects, it is common for horizontal support structures to be installed throughout the project, such as beams, joists and the like. These structures can run from wall to wall, wall to beam, or beam to beam to support a ceiling, roof, floor or platform throughout the construction process. It is also common for a deck to be installed atop the joists to provide a more manageable means of mobility of workers. In other cases, steel pipes might be positioned around the construction project to support beams and the like, or to mark the perimeter of the construction site.

Figure 3:
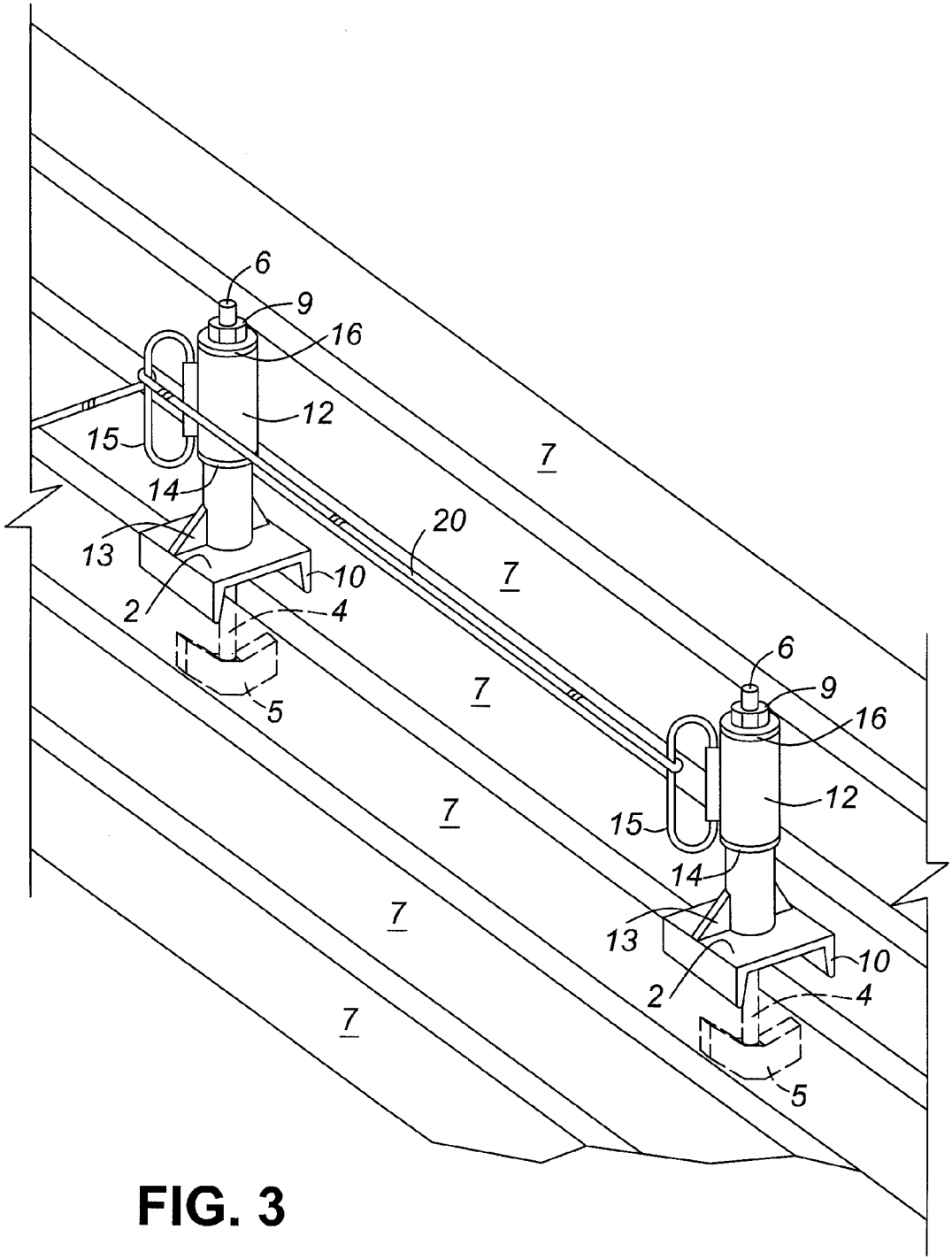
FIG. 3 shows a perspective view of an example of a portable anchor in accordance with a further embodiment of the present invention.

The anchor (1) can be attached to a solid support structure (7), such as a horizontal support structure, steel pipe or decking, by inserting the anchoring section (5) of the rod (4) between two adjacent beams, joists or decking structures (see FIG. 3). In the case of a steel pipe, the rod (4) can be inserted into the steel pipe and the base (2) secured to the steel pipe.

The rod (4) comprises an anchoring section (5) and a locking section (6). In operation, the anchoring section (5) frictionally engages a portion of the solid support structure (7) to secure the anchor (1) in place. As shown in FIG. 2, the anchoring section (5) is anchor-shaped having at least two wings (8), which allows it to be inserted in between adjacent beams, joists or decking structures (7) and then rotated so that wings (8) abut, or frictionally engage, the underside of the adjacent beams, joists or decking structures (7). Although it is preferred that the anchoring section (5) is anchor-shaped it should be understood that any shape that allows the rod (4) to be inserted in between adjacent beams, joists or decking and then rotated to secure the anchor in place will function in the present invention.

As for a steel pipe, the anchoring section (5) of the rod (4) is inserted in the steel pipe and the base (2) of the anchor (1) is welded, or otherwise secured, to the steel pipe in order to prevent detachment of the anchor (1) from the steel pipe. In this case, the wings (8) of the anchoring section (5) abut the underside of the base (2) to prevent movement of the anchor (1) relative to the steel pipe.

In operation, the anchoring section (5) of the rod (4) is inserted in between the adjacent components of the solid support structure (7). With the anchor (1) positioned with the rod (4) inserted through the central bore (11), the rod spans the longitudinal axis of the base (2) and post (3). At the end of the rod (4) opposite the anchoring section (5) is the locking section (6). The locking section (6) functions to reversibly secure the rod (4) to the rest of the anchor (1), in particular the post (3). In one embodiment, the locking section (6) is composed of threads that circumnavigate the surface of the rod (4). In order for the anchor (1) to be used in a greater number of applications, the threads can be provided over the whole length of the rod (4). However, at a minimum, the portion of the rod (4) that extends out of the post (3) should be threaded, so that an internally threaded female substrate (9) can be positioned on the rod (4) and used to compress the anchor (1) against the solid support structure (7). Suitable internally threaded female substrates (9) include, but are not limited to, hexagon nuts, wing nuts and handles. In operation, the internally threaded female substrate (9) is tightened against the top of the post (3) to draw the rod (4) towards the base (2) of the anchor (1). Depending on the diameter of the central bore (11) in relation to the rod (4), one or more washers may be provided between the internally threaded female substrate (9) and the top of the post (3).

In an alternate embodiment, a series of holes transversing the rod (4) are provided within the locking section (6) of the rod (4). These holes are dimensioned to receive a cotter pin, which prevents vertical movement of the rod (4) in relation to the post (3). In operation, the rod (4) is physically pulled through the anchor (1) and then secured to the post (3) by inserting a cotter pin through the holes in the rod (4).

Figure 7:
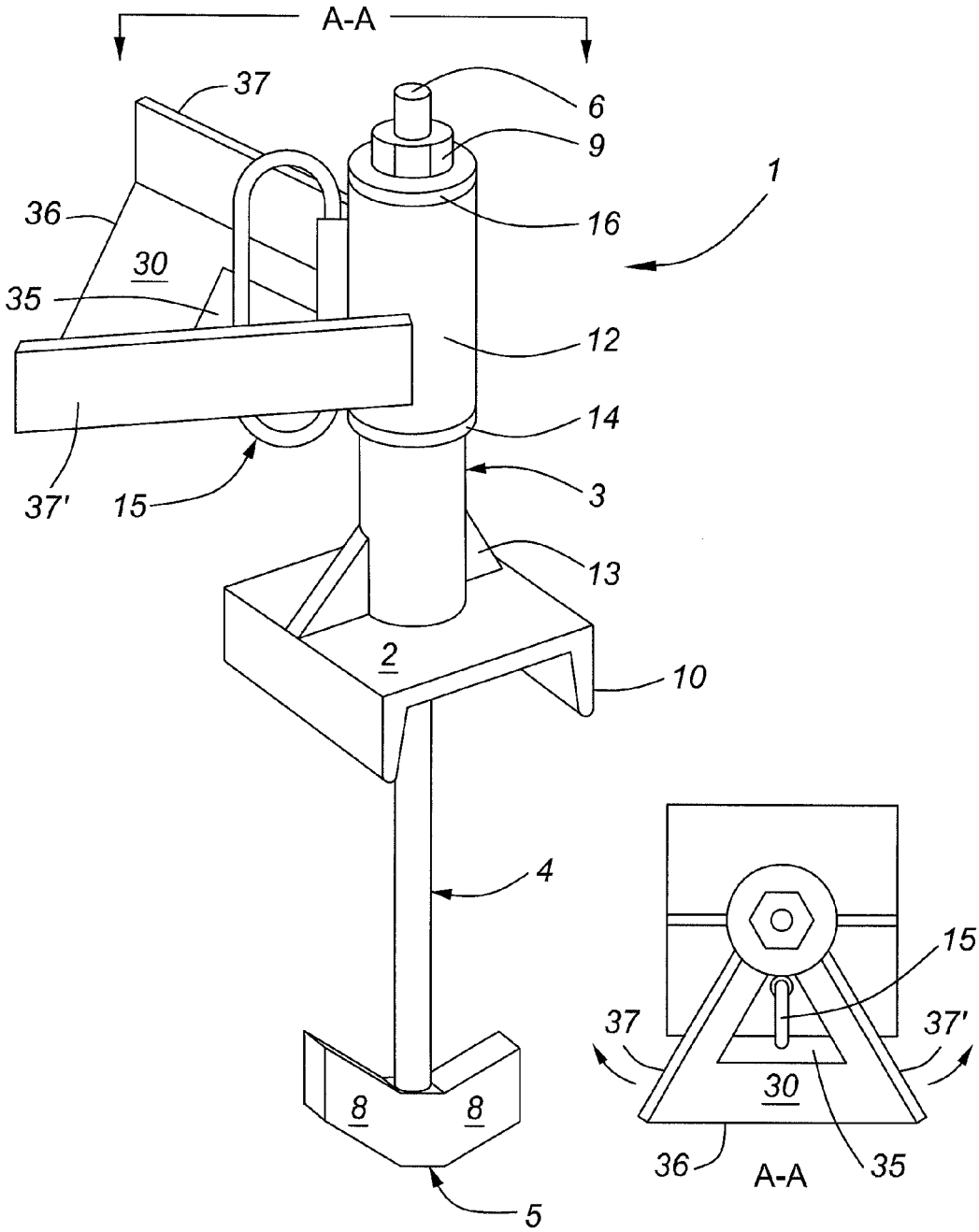
FIG. 7 shows a perspective view of an example of a portable anchor in accordance with a further embodiment of the present invention, in which a supporting element such as a tray or similar receptacle is provided to receive and support a retractable lanyard or other connector.

In a further optional embodiment, as illustrated in FIG. 7, the anchor (1) may include a supporting element (30), such as a tray or similar receptacle, in order to support the connector (e.g. a retractable lanyard or similar connector) when not in use. The supporting element (30) can be welded or otherwise attached to the post (3) or sleeve (12) (if present) at a position near the attachment point (15) such that the connector can be connected to the attachment point (15) and received within the supporting element (30) when not in use. In the non-limiting embodiment illustrated in FIG. 7, the supporting element (30) is attached to the sleeve (12) with a clearance, or notch (35), formed in the supporting element (30) to accommodate the dimensions of the attachment point (15). In this embodiment, the lower portion of the attachment point (15) protrudes through the base (36) of the supporting element (30). Preferably, sidewalls (37, 37') are provided extending upwards from the base (36) to form a partial enclosure to receive the connector.

One or more currently preferred embodiments have been described by way of example. It will be apparent to persons skilled in the art that a number of variations and modifications can be made without departing from the scope of the invention as defined in the claims.

What is claimed is:

1. A portable anchor for use in a fall arrest protection system, said anchor comprising:

a base that abuts a solid support structure, the base comprising a bracket that abuts the solid support structure, said bracket being dimensioned to envelop and receive at least a portion of the solid support structure so as to minimize lateral movement of the base in relation to the solid support structure when secured thereto;

a post extending perpendicularly from the base, wherein the central bore is provided through the base and post;

at least one attachment point connected to the post for receiving a connector; and a rod adapted to be inserted through the central bore, the rod comprising an anchoring section at a first end of the rod for frictionally engaging a portion of the solid support structure and a locking section in the vicinity of at or near a second end of the rod for reversibly securing the rod to the post.

2. The portable anchor of claim 1, further comprising a sleeve that at least partially encircles the post and is adapted for rotation about the longitudinal axis of the post, wherein the at least one attachment point is indirectly connected to the post through the sleeve.

3. The portable anchor of claim 2, further comprising a first annular flange positioned on the post to vertically support the sleeve.

4. The portable anchor of claim 3, further comprising a second annular flange positioned on the post vertically above the sleeve to minimize vertical movement of the sleeve in relation to the post, wherein a central bore is provided in the second annular flange to accommodate passage of the rod.

5. The portable anchor of claim 2, wherein the at least one attachment point pivots with respect to the post.

6. The portable anchor of claim 2, wherein the at least one attachment point comprises two attachment points.

7. The portable anchor of claim 2, further comprising a supporting element attached to the sleeve at a position near the attachment point such that the connector can be connected to the attachment point and received within the supporting element.

8. The portable anchor of claim 7, wherein the supporting element comprises a base with sidewalls extending upwards from the base to form a partial enclosure, and a clearance formed in the supporting element to accommodate the dimensions of the attachment point.

9. The portable anchor of claim 1, further comprising one or more trusses bridging the base and the post.

10. The portable anchor of claim 1, wherein the locking section of the rod comprises threads circumnavigating the rod which can be operably engaged by a corresponding internally threaded female substrate to draw the rod toward the base.

11. The portable anchor of claim 10, wherein the internally threaded female substrate is selected from a hexagon nut, wing nut and handle.

12. The portable anchor of claim 1, wherein the at least one attachment point pivots with respect to the post.

13. The portable anchor of claim 1, wherein the at least one attachment point comprises two attachment points.

14. The portable anchor of claim 1, further comprising a supporting element attached to the post at a position near the attachment point such that the connector can be connected to the attachment point and received within the supporting element.

15. The portable anchor of claim 14, wherein the supporting element comprises a base with sidewalls extending upwards from the base to form a partial enclosure, and a clearance formed in the supporting element to accommodate the dimensions of the attachment point.

16. A method of attaching the portable anchor of claim 1 to a solid support structure, the method comprising the steps of: inserting the anchoring section of the rod between a portion of two adjacent solid support structures, the rod passing through the central bore provided through the base and the post; and engaging the locking section of the rod to draw the anchoring section of the rod towards the base until the anchoring section frictionally engages a portion of each of the adjacent solid support structures.

17. A fall arrest protection system comprising an anchor, said anchor comprising:

a base that abuts to a solid support structure, the base comprising a bracket that abuts the solid support structure, said bracket being dimensioned to envelop and receive at least a portion of the solid support structure so as to minimize lateral movement of the base in relation to the solid support structure when secured thereto;

a post extending perpendicularly from the base, wherein a central bore is provided through the base and post;

at least one attachment point connected to the post for receiving a connector; and a rod adapted to be inserted through the central bore, the rod comprising an anchoring section at a first end of the rod for frictionally engaging a portion of the solid support structure and a locking section at or near a second end of the rod for reversibly securing the rod to the post.

18. The system of claim 17, further comprising a sleeve that at least partially encircles the post and is adapted for rotation about the longitudinal axis of the post, wherein the at least one attachment point is indirectly connected to the post through the sleeve.

* * * * *